US005156368A

United States Patent [19]

Swanson

[11] Patent Number: 5,156,368

[45] Date of Patent: Oct. 20, 1992

[54] COMBINATION MUSIC RACK AND CASE

[76] Inventor: Eleanor V. Swanson, 2135 Indiana Ave., Golden Valley, Minn. 55422

[21] Appl. No.: 764,237

[22] Filed: Sep. 23, 1991

[51] Int. Cl.[5] ..... A47B 97/04

[52] U.S. Cl. ..... 248/461; 190/11; 248/447.1; 248/447.1

[58] Field of Search ..... 248/460, 461, 447, 447.2, 248/447.1, 455, 456, 441.1, 444.1; 281/33; 190/11; 108/39, 40; 312/233, 244

[56] References Cited

U.S. PATENT DOCUMENTS

| | | | |
|---|---|---|---|
| 649,293 | 5/1900 | French | 248/456 |
| 1,962,988 | 6/1934 | Fulton | 190/11 X |
| 2,194,019 | 3/1940 | Hartsel | 248/461 X |
| 2,549,306 | 4/1951 | Greene . | |
| 3,041,774 | 7/1962 | Walker . | |
| 3,136,082 | 6/1964 | Sloves . | |
| 3,297,118 | 1/1967 | Van Skyhawk et al. . | |
| 3,773,154 | 11/1973 | Mitchell | 248/455 |
| 4,101,184 | 7/1978 | Barrett . | |
| 4,342,492 | 8/1982 | Spevak | 312/244 |
| 4,471,933 | 9/1984 | Nelson | 248/461 |
| 4,588,074 | 5/1986 | Strong et al. . | |
| 4,781,355 | 11/1988 | Jeantin . | |
| 4,790,506 | 12/1988 | Malinowski et al. . | |
| 4,819,902 | 4/1989 | Wenger et al. . | |
| 4,852,498 | 8/1989 | Judd | 190/11 X |
| 4,852,909 | 8/1989 | Stoyanoff . | |

FOREIGN PATENT DOCUMENTS

| | | | |
|---|---|---|---|
| 2450584 | 11/1980 | France | 248/461 |

*Primary Examiner*—J. Franklin Foss

*Attorney, Agent, or Firm*—Palmatier & Sjoquist

[57] ABSTRACT

A combination rack and carrying case for carrying and displaying sheets of paper such as sheets of music. As one of its sidewalls, the rack includes a swingable generally Z-shaped rack with outer and inner ledges for supporting the sheets of music. The outer ledge is operable when the rack is in a retracted position. The inner ledge becomes operational when the rack is swung to an elevated, extended position.

22 Claims, 2 Drawing Sheets

COMBINATION MUSIC RACK AND CASE

BACKGROUND OF THE INVENTION

The present invention relates to a combination musical score rack and case and, more particularly, to such a combination with the rack swingably affixed to and forming a portion of the case.

Both amateur and professional performing musicians often spend intensive, extraordinary amounts of time practicing their instruments. For such musicians, repetition is the mother of study. Accordingly, these artisans may take their musical scores and instruments to and from work and school, to weekend retreats, along on vacations, or to a great many other places where they may have time for practicing their chosen art.

SUMMARY OF THE INVENTION

An object of the present invention is to provide means for displaying musical scores on a case for transporting the musical scores.

A feature of the present invention is the combination of a case for carrying musical scores and a rack on the case and having at least one ledge for displaying the musical scores.

Another feature is the provision in such a combination, of the rack portion being swingable relative to the case portion to provide a second ledge disposed at a different position relative to the first ledge.

Another feature is the provision in such a combination, of the different position of the second ledge being an elevated position.

Another feature is the provision in such a combination, of the rack portion forming one of the sidewalls of the case portion such that access to the interior of the case portion is obtained when the rack portion is swung to an extended position.

Another feature is the provision in such a combination, of attachment means on the case portion for attaching the combination rack and case to an object such as a wall.

Another feature is the provision in such a combination, of the attachment means including swingable means for swinging the combination rack and case away from the object so that the musician may play her instrument away from the object.

An advantage of the present invention is convenience. A musician may have at her ready disposal both a case for carrying musical scores and a rack for displaying the musical scores.

Another advantage is that a music rack and musical score case are consolidated so that the musician has one less piece of luggage to carry.

Another advantage is that musical scores may be located at different elevations relative to the case portion. Accordingly, after the case portion has been placed on a surface or mounted on a wall, the musician may orient her score at the desired elevation.

Another advantage is that, when the case is mounted on a wall, the rack may be positioned at a 90° angle relative to the wall so that musicians, especially horn players, may direct their instruments away from the wall to minimize the amount of sound waves bouncing immediately off the wall. Moreover, such an orientation permits trombone players to stand or sit closer to wall-mounted racks.

Another advantage is that the present invention is simple and inexpensive to manufacture.

Another advantage is that the present invention is simple to use.

DETAILED DESCRIPTION OF THE PREFERRED EMBODIMENTS

Figure 1:
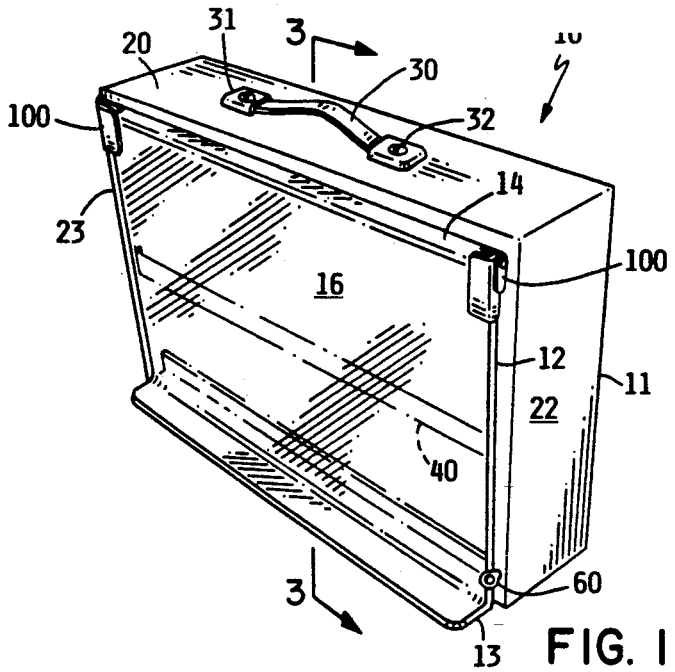
FIG. 1 is a perspective view of the present music rack and case.

The present music rack and case combination is indicated in general by the reference numeral 10. It includes as its principal components a case portion 11 and a generally Z-shaped, transparent, panel-like rack portion 12 which includes a pair of integral, right-angled ledges 13, 14 extending from opposing edges of the rack portion 12 for supporting musical scores 15. The rack portion 12 is swingable between retracted and extended or elevated positions in which one of the ledges 13, 14 is operable and the other of the ledges 13, 14 is disposed out-of-the way. In the retracted position, the musical scores 15 rest upon the ledge 13 and a first, outer face 16 of the rack portion 12. In the elevated position, the musical scores 15 rest upon the ledge 14 and a second, inner face 17 of the rack portion 12.

Figure 2:
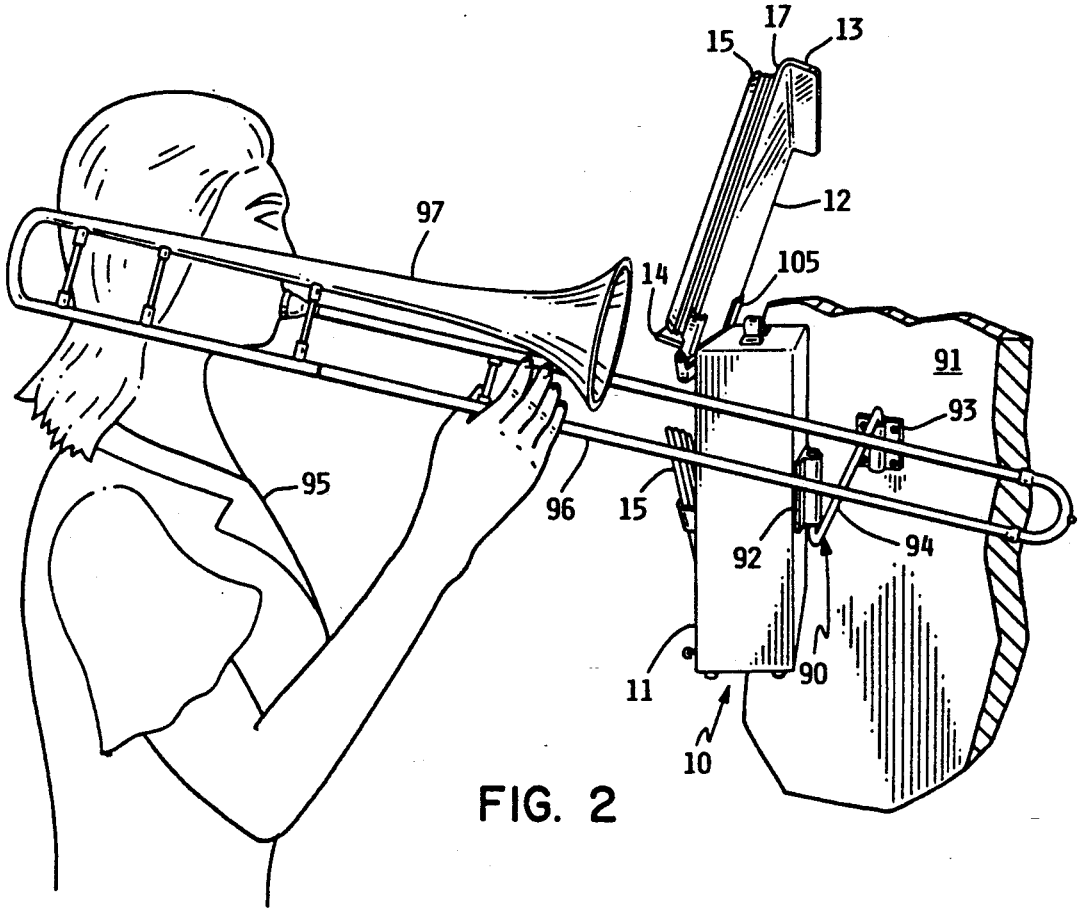
FIG. 2 is a perspective view of the music rack and case of FIG. 1 from another angle and shows the music rack and case mounted on a wall for a trombone player.
Figure 3:
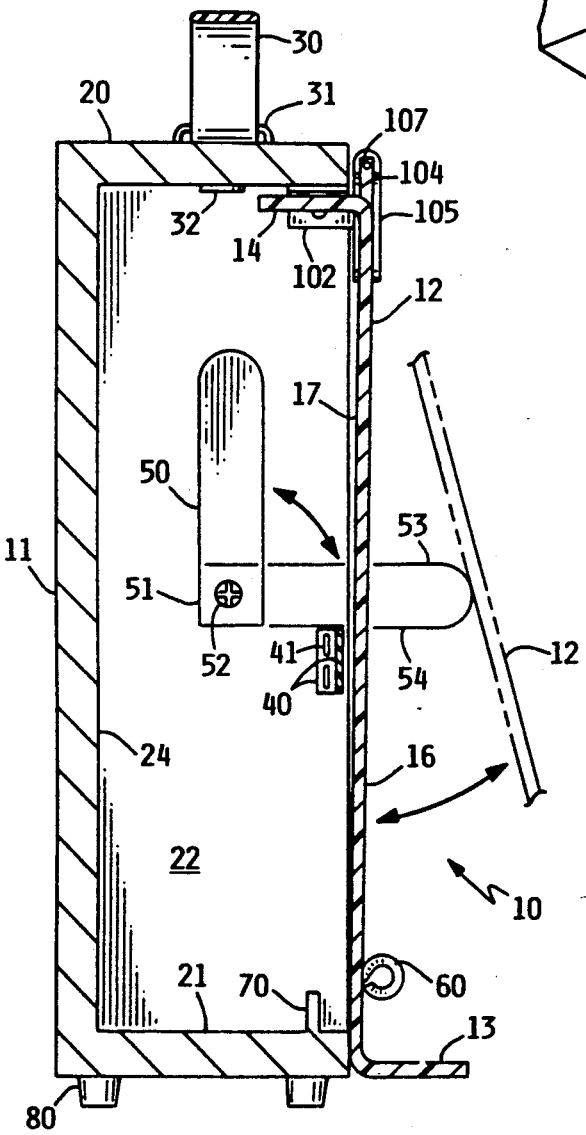
FIG. 3 is a detail section view at lines 3—3 of FIG. 1.

With more specificity, as shown in FIGS. 1, 2, and 3, the case portion 11 is preferably formed in the shape of a rectangular briefcase and includes a pair of parallel, elongate, top and bottom walls 20, 21 and a pair of parallel elongate end walls 22, 23 which are fixed to and between the top and bottom walls 20, 21. The case portion 11 further includes a rectangular sidewall 24 fixed to and between walls 20–23. The walls 20–24 are formed of wood, although other materials, including more flexible materials such as leather, may be used.

A handle 30 is affixed to the top wall 20 via end connectors 31. Each of the end connectors 31 includes a pin connector 32 engaging the top wall 20. Each of the pin connectors 32 also engages a respective slot formed in each of the ends of the handle 30 such that the handle 30 may be flattened onto the upper surface of the top wall 20 to be partially retracted into the end connectors 32 and such that the handle 30 may be partially extended away from the upper surface of the top wall 20 to be readily grasped.

An elastic strap or upper retaining means 40 is fixed to and between the end walls 22, 23 and spaced from the sidewall 24 to permit musical scores or sheets of paper 15 to be stored between the strap 40 and the sidewall 24. The strap 40 is resilient to permit the musical scores 15 to extend partially from the case portion 11 when the rack portion 12 is swung to an elevated position to in turn permit ready access to the musical scores 15, as shown in FIG. 2. The strap 40 is fixed to the end walls 22, 23 via pin connectors 41.

As shown in FIG. 3, a swing arm 50 is swingably affixed to the inside surface of end wall 22 for holding the rack portion 12 at one of its oblique positions relative to the case portion 11 for easy viewing of the musical score 15 by the musician. The swing arm 50 includes a proximal end 51 fixed to the end wall 22 via a pin connector 52. The swing arm 50 further includes a distal, rounded end 53 for engaging and positioning the rack portion 12 at its oblique orientation. The swing arm 50 further includes a bottom edge or stop 54 for engaging an end portion of the strap 70 to prevent a further downward swing of the swing arm 50 when the distal end 53 abuts the rack portion 12.

An eyelet or rack locking means 60 is rotatably fixed in end wall 22 for locking the rack portion 12 to the case portion 11 and for preventing the rack 12 from swinging or opening inadvertently. When the eyelet 60 is turned out of a vertical plane, it engages a vertical edge portion of the rack portion !2 to prevent swinging of the rack portion 12.

A flange or lower retaining means 70 extends from the inner surface of the bottom wall 21 and between the end walls 22, 23, and is spaced from the sidewall 24 to retain the musical scores or sheets of paper 15 in the case portion 11. The flange or lower retaining means 70 acts to retain the bottom portions of the musical scores 15 while the strap or upper retaining means 70 acts to retain the upper portions of the musical scores 15 in the case portion 11.

A set of four feet 80 are affixed adjacent to respective corners of the bottom wall 21 for supporting the rack and case combination 10 on a horizontal surface such as a floor or table top. The feet 80 may be of a rubber or rubberlike or resilient or plastic material to minimize a skidding on or a marking of surfaces.

An attachment means 90 is fixable to a central region of the sidewall 24 for mounting the rack and case combination 10 to an object such as a wall 91. The attachment means 90 includes a pair of hinge-like brackets 92, 93 for attachment to the sidewall 24 and wall 91, respectively, via pin connectors. A bent support rod 94 is formed in generally the shape of a "Z" for pivotally engaging each of the hinge-like brackets 92, 93. Accordingly, the rack and case combination 10 is swingable relative to both the wall 91 and the rod 94 such that the rack 12 is positionable at a 90° angle relative to the wall 91. Hence, a musician such as a trombone player 95 may direct both the slide 96 of her trombone 97 and the music emanating from the trombone 97 away from or at least parallel to the wall 91 while reading the musical score 15.

Figure 4:
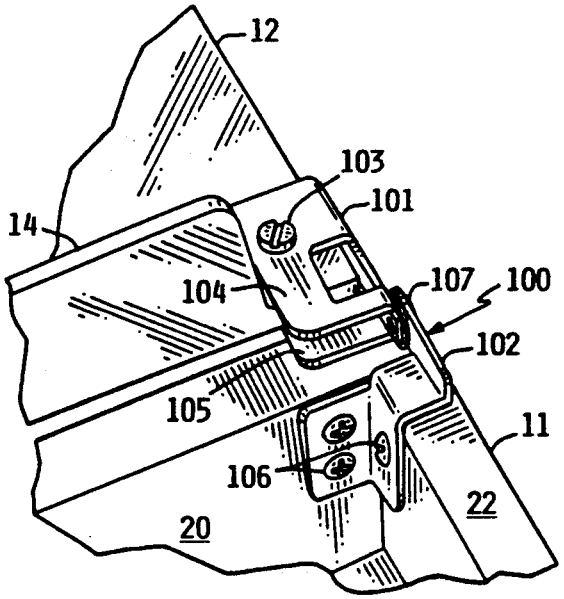
FIG. 4 is a detail view of one of the hinges of the music rack and case of FIG. 1.

As shown in FIG. 4, the rack portion 12 is swingably affixed to the case portion 11 via a pair of hinges 100. Each of the hinges 100 includes a pair of hinge portions 101, 102. Hinge portion 101 is affixed to a corner of the rack portion 12 via a pin connector 103 adjacent to the ledge 14, whose ends are spaced from the vertical edges of the rack portion 12. Hinge portion 101 includes a pair of plate sections 104, 105 which pinch the corner of the rack portion 12. Hinge portion or bracket 102 is fixed to the inside surfaces of top wall 20 and end wall 22 via pin connectors 106. Hinge portions 101, 102 are connected via a pivot pin 107.

In operation, the rack portion or panel 12 acts as a sidewall of the case portion 11 when in its retracted position parallel to the sidewall 24. In such a retracted position, the rack portion 12 engages the front edge of the bottom wall 21 and extends adjacent to and slightly obliquely of the front edges of end walls 22, 23 to retain the musical scores 15 in the rack and case combination 10 during transport.

When musical scores 15 are to be displayed, one of the ledges 13, 14 is utilized. When ledge 13 is to be used, the rack portion 12 may be left in its retracted position or may be swung to an oblique position where it is engaged by the swing arm 50, as shown in FIG. 3. When ledge 14 is to be used, the rack portion 12 is swung to an elevated, oblique position, as shown in FIG. 2. In such an elevated position, the hinge sections 105 engage the front edge of the top wall 20 to support the rack 12 in an oblique as well as elevated position.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A combination rack and case for carrying and displaying sheets of paper, comprising:

a) a case portion for retaining sheets of paper therein;

b) a rack portion swingably affixed to the case portion and comprising first and second face portions, the rack portion being swingable between retracted and extended positions; and c) a pair of ledge portions extending from the rack portion for supporting and displaying the sheets of paper, one of the ledge portions supporting sheets of paper when the rack portion is in the retracted position, the other ledge portion supporting sheets of paper when the rack portion is in the extended position.

2. The invention of claim 1, wherein one of the ledge portions extends from the first face of the rack portion and the other ledge portion extends from the second face of the rack portion.

3. The invention of claim 1, and the rack portion comprising opposing edge portions, wherein each of the ledge portions extends from one of the edge portions.

4. The invention of claim 3, wherein one of the ledge portions extends from the first face of the rack portion and the other ledge portion extends from the second face of the rack portion.

5. The invention of claim 1, wherein the rack portion comprises a panel.

6. The invention of claim 5, wherein the panel comprises a transparent portion.

7. The invention of claim 1, wherein the case portion comprises at least a pair of sidewalls, and the rack portion forming at least a portion of one of the sidewalls in the retracted position.

8. The invention of claim 7, wherein the case portion further comprises retaining means spaced from one of the sidewalls to retain sheets of paper in the case when the rack is in the extended position.

9. The invention of claim 8, wherein the retaining means comprises a resilient flexible element.

10. The invention of claim 7, wherein the case portion further comprises elongate top, bottom, and end walls.

11. The invention of claim 1, further comprising a handle affixed to the case portion for carrying the combination rack and case.

12. The invention of claim 1, comprising an arm disposed between the rack portion and the case portion for positioning the rack portion obliquely of the case portion.

13. The invention of claim 1, wherein the case portion comprises attachment means for attachment to an object.

14. The invention of claim 13, wherein the case portion is swingable relative to the attachment means.

15. The invention of claim 13, wherein the attachment means comprises a support extending from the case portion to a base, the base being fixable to the object, the support being swingable relative to the base.

16. The invention of claim 1, further comprising means for locking the rack portion to the case portion.

17. A combination rack and case for carrying and displaying sheets of paper, comprising:

a) a case portion comprising:

1) a pair of elongate top and bottom walls, a pair of elongate end walls affixed to and between the top and bottom walls, and a sidewall affixed to and between the top and bottom walls and to and between the end walls;

2) a handle affixed to the top wall for carrying the combination rack and case;

3) a swing arm swingably affixed to and extending from one of the walls and comprising a distal end; and 4) retaining means for retaining sheets of paper in the case portion and being spaced from the sidewall and disposed between the end walls;

b) a rack portion comprising:

1) a panel swingably affixed to the case portion and disposed transversely of the sidewall, the panel comprising inner and outer faces and upper and lower edges, the panel having retracted and extended positions; the panel being supportable in an oblique position by the distal end of the swing arm;

2) a lower ledge extending from the outer face and lower edge for supporting sheets of paper when the panel is in its retracted position, and 3) an upper ledge extending from the inner face and upper edge for supporting sheets of paper when the panel is in its extended position; and c) means for locking the rack portion against swinging relative to the case portion; whereby the rack portion may support sheets of paper in either the retracted or extended position.

18. A combination rack and case for carrying and displaying sheets of paper, comprising:

a) a case portion for retaining the sheets of paper therein;

b) a rack portion pivotally affixed on the case portion and being upwardly pivotable from a retracted position to an extended position; and c) a pair of ledge portions extending from the rack portion for supporting and displaying the sheets of paper, one of the ledge portions supporting sheets of paper when the rack portion is in the retracted position, the other ledge portion supporting sheets of paper when the rack portion is in the extended position.

19. The invention of claim 18, further comprising attachment means for attaching the case portion to an object.

20. The invention of claim 19, wherein the object includes a vertically extending portion.

21. The invention of claim 20, wherein the attachment means comprises swingable means for swinging the case portion relative to the object.

22. A combination rack and case for displaying and carrying sheets of paper, comprising:

a) a case portion for retaining the sheets of paper therein;

b) a rack portion hingedly connected to the case portion and being swingably adjustable to at least two different elevations for supporting and displaying the sheets of paper at different elevations relative to the case portion, the rack portion including first and second face portions; and c) a pair of ledge portions extending from the rack portion for supporting and displaying the sheets of paper, one of the ledge portions and one of the face portions supporting the sheets of paper at one of the elevations, the other ledge portion and the other face portion supporting the sheets of paper at the other elevation.

* * * * *